US006400073B1

(12) United States Patent
Mihira et al.

(10) Patent No.: US 6,400,073 B1
(45) Date of Patent: Jun. 4, 2002

(54) DOUBLE-FACED FLUORESCENT DISPLAY TUBE AND METHOD OF MANUFACTURING THE SAME

(75) Inventors: Akihiro Mihira; Yoichi Mera; Tadashi Mizohata; Katsushi Tokura, all of Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/263,874

(22) Filed: Mar. 8, 1999

(30) Foreign Application Priority Data

Mar. 12, 1998 (JP) ..... 10-061453
Nov. 18, 1998 (JP) ..... 10-328622

(51) Int. Cl.[7] ..... H01J 1/62; H01J 63/04

(52) U.S. Cl. ..... 313/495; 313/496; 313/497; 313/509

(58) Field of Search ..... 313/495, 496, 313/497, 505, 506, 509, 512

(56) References Cited

U.S. PATENT DOCUMENTS 4,654,559 A * 3/1987 Hinotani et al. ..... 313/422
5,256,936 A * 10/1993 Itoh et al. ..... 313/495

* cited by examiner

*Primary Examiner*—Vip Patel
*Assistant Examiner*—Kevin Quarterman
(74) *Attorney, Agent, or Firm*—Oblon, Spivak, McClelland, Maier & Neustadt, P.C.

(57) ABSTRACT

A double-faced fluorescent display tube is provided which is capable of reducing the insulation failure and breaking of wiring patterns and capable of improving a luminous efficiency by reducing an ineffective current of an anode. An envelope 1 comprises a back substrate 2 and a front substrate 3 facing each other and a frame-like side plate sealed between the substrates 2 and 3. A wiring pattern 13 is formed on the inner surface of the front substrate 3. A transparent anode conductor 14 is connected to the wiring pattern 13. A phosphor layer 15 is formed on the anode conductor 14. A control electrode 17 is disposed at a predetermined distance away from the phosphor layer 15. An exposed portion of the wiring pattern 13 on the front substrate 3 is covered with a transparent and insulating $SiO_2$ film 19.

4 Claims, 8 Drawing Sheets

DOUBLE-FACED FLUORESCENT DISPLAY TUBE AND METHOD OF MANUFACTURING THE SAME

BACKGROUND OF THE INVENTION

1. Field of the Invention

The present invention relates to a double-faced fluorescent display tube comprising an envelope including luminescent display portions on the respective inner surfaces of front and back substrates, cathodes for emitting electrons and control electrodes, and a method of manufacturing the double-faced fluorescent display tube.

2. Description of the Related Art

A double-faced fluorescent display tube has been heretofore used as a display apparatus in various fields of audio equipment or the like. This double-faced fluorescent display tube comprises an envelope formed of facing front and back substrates and a side plate, the envelope including: luminescent display portions composed of a phosphor layer and anodes which the phosphor layer is deposited on; cathodes for emitting electrons; and control electrodes arranged between the luminescent display portions and the cathodes. The double-faced fluorescent display tube is known to be of types: one type of the tube in which two luminescent display portions are observed from one substrate side of the envelope; and another type of the tube in which the luminescent display portions are observed from the substrate sides.

FIG. 9 is a partially enlarged side sectional view showing an example of this type of conventional double-faced fluorescent display tube.

As shown in FIG. 9, the double-faced fluorescent display tube has an envelope 1. The envelope 1 is assembled like a box from back and front substrates 2 and 3 formed of a plate material such as transparent glass and a side plate which the back and front substrates are surrounded by. A wiring pattern 5 composed of an Al thin film is formed on the inner surface of the back substrate 2. A black color insulating layer 7 having a through-hole 6 is formed on the wiring pattern 5. An anode 8 is formed on the through-hole 6 of the insulating layer 7. The anode 8 is connected to the wiring pattern 5 through a conductive material 9 which the through-hole 6 is filled with. A phosphor layer 10 is formed on the anode 8, thereby constituting a back-side luminescent display portion 11. A mesh grid 12 is placed as the back-side control electrode over the back-side luminescent display portion 11 at a predetermined distance away therefrom.

On the other hand, stripe-like wiring patterns 13 composed of the Al thin film are formed on the inner surface of the front substrate 3 with a predetermined distance therebetween. A part of the wiring pattern 13 is connected to transparent anodes 14. A phosphor layer 15 is formed on the anodes 14, thereby constituting a front-side luminescent display portion 16. A mesh grid 17 is placed as the front-side control electrode under the front-side luminescent display portion 16 at a predetermined distance away therefrom. In the envelope 1, filamentary cathodes 18 for emitting the electrons are disposed between the mesh grids 12 and 17.

In the conventional double-faced fluorescent display tube constituted as described above, a space is provided around the wiring patterns 13 of the front substrate 3. It is thereby possible to observe, from the side of the front substrate 3, the luminescent display of both of the back-side luminescent display portion 11 on the back substrate 2 and the front-side luminescent display portion 16 on the inner surface of the front substrate 3. Thus, the wiring patterns 13 on the side of the front substrate 3 are exposed. This has a problem. That is, conductive contaminants or the like produced in a manufacturing step adhere to the space between the wiring patterns 13. As a result, a short-circuit occurs between wires, thus yielding insulation failure. Particularly, sparks generated by electrically welding the electrodes, a getter film, or the like move through the envelope 1 and adhere to the space between the wiring patterns 13. Due to this, the short-circuit takes place between the wiring patterns 13 and thus brings about the insulation failure, or the wiring patterns 13 are damaged and thus broken. Such a problem is prone to arise.

The present invention is therefore made in view of the above problem. An object of the present invention is to provide a double-faced fluorescent display tube capable of reducing the insulation failure and breaking of the wiring patterns caused due to the conductive contaminants or the like produced in the manufacturing step and capable of improving a luminous efficiency of the phosphor by reducing an ineffective current of the anode, and a method of manufacturing the double-faced fluorescent display tube.

SUMMARY OF THE INVENTION

In order to achieve the above object, according to a first aspect of the invention, there is provided a double-faced fluorescent display tube comprising: an envelope formed of two substrates facing each other whose outer periphery is sealed, in which the respective inner surfaces of the substrates have a luminescent display portion and a wiring pattern connected to the luminescent display portion, wherein an exposed portion of the wiring pattern is covered with a transparent insulating film.

According to a second aspect of the invention, there is provided a double-faced fluorescent display tube comprising: an envelope formed of back and front substrates facing each other and a frame-like side plate sealed between the back and front substrates, in which an inner surface of the back substrate has a wiring pattern, a black color insulating layer which the wiring pattern is covered with, an anode disposed on the insulating layer and connected to the wiring pattern through a through-hole, a phosphor layer disposed on the anode, and a control electrode disposed at a predetermined distance away from the phosphor layer; an inner surface of the front substrate has a wiring pattern, transparent anodes connected to the wiring pattern, a phosphor layer disposed on the anodes, and a control electrode disposed at a predetermined distance away from the phosphor layer; and cathodes are stretchedly disposed between the control electrodes, wherein an exposed portion of the wiring pattern on the front substrate is covered with a transparent insulating film.

According to a third aspect of the invention, there is provided a double-faced fluorescent display tube according to the second aspect, wherein the whole surface of the front substrate is covered with a transparent insulating film, except the luminescent display portion and an internal terminal.

According to a fourth aspect of the invention, there is provided a double-faced fluorescent display tube according to the first, second or third aspect, wherein the insulating film comprises $SiO_2$ thin film.

According to a fifth aspect of the invention, there is provided a method of manufacturing a double-faced fluorescent display tube, the tube comprising an envelope formed of facing front and back substrates and a side plate, the envelope including: an inner surface of the front substrate having a plurality of luminescent display portions composed of a phosphor layer and anodes which the phosphor layer is deposited on, a wiring pattern which the plurality of anodes are connected to, and an internal terminal connected to the wiring pattern; cathodes for emitting electrons; and a control electrode arranged between the luminescent display portions and the cathodes, the method comprising the steps of: forming the anodes, the wiring pattern, the internal terminal and first register marks on the front substrate by using a first patterning member having a plurality of first register marks whose shape represents a misalignment tolerance which is a level that is allowed even when a second patterning member is misaligned; and forming a transparent insulating film on the front substrate by using a second patterning member having a plurality of second register marks corresponding to the first register marks, while the second register marks are matched to the first register marks formed on the front substrate within the misalignment tolerance.

According to a sixth aspect of the invention, the first register mark may be formed of a rectangular mark whose width is equal to the misalignment tolerance.

According to a seventh aspect of the invention, the second register mark may be formed of a mark having a blank whose dimension is identical with an outer dimension of the first register mark.

According to an eighth aspect of the invention, the second patterning member may be constituted so as to form the insulating film on the inner surface of the front substrate except the luminescent display portion and the internal terminal.

DETAILED DESCRIPTION OF THE PREFERRED EMBODIMENTS

Figure 9:
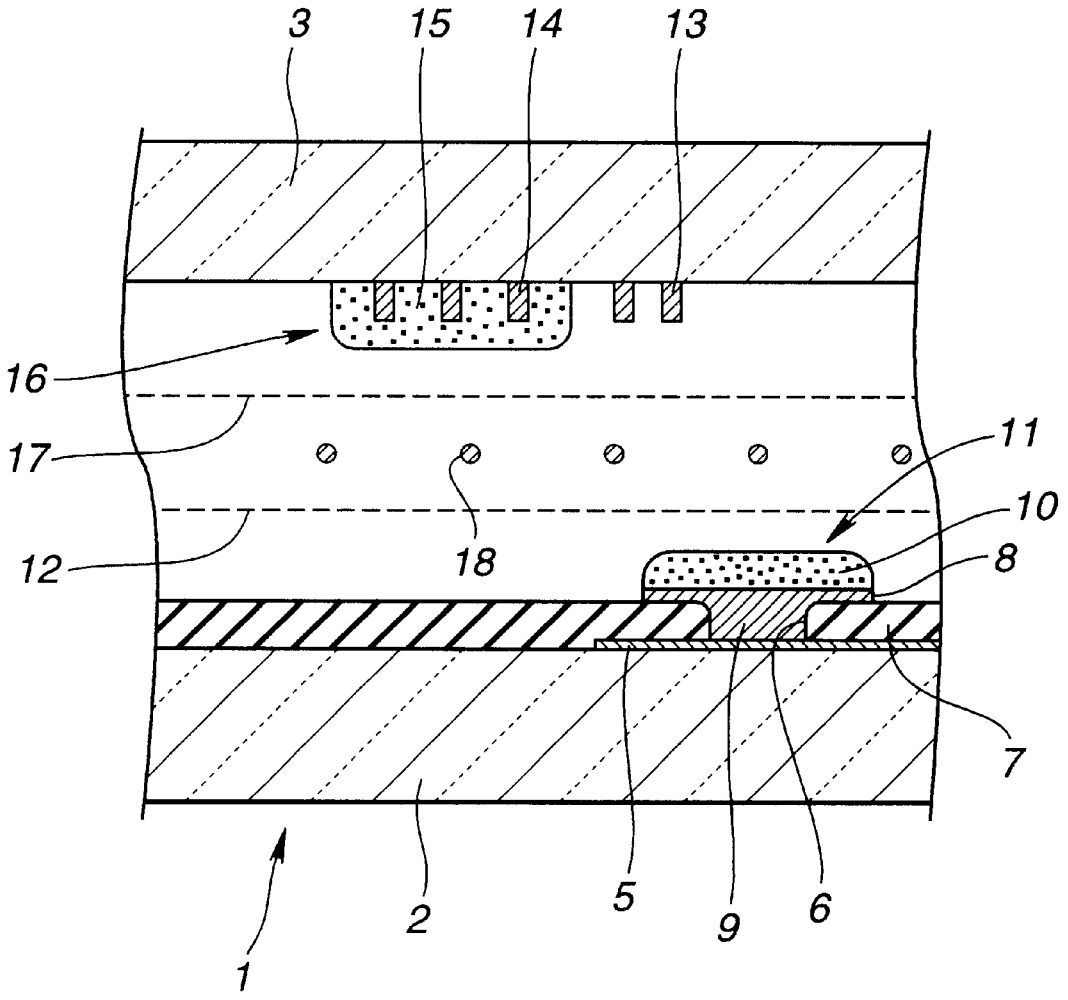
FIG.9 (PRIOR ART)
FIG. 9 is a partially enlarged side sectional view showing an example of the prior double-faced fluorescent display tube.

Embodiments of the present invention will be described below. In the following drawings, the same elements as the elements of the prior double-faced fluorescent display tube shown in FIG. 9 have the same reference numerals. A basic constitution of the double-faced fluorescent display tube according to this embodiment is the same as the constitution shown in FIG. 9. The features of this embodiment will be mainly described below.

Figure 1:
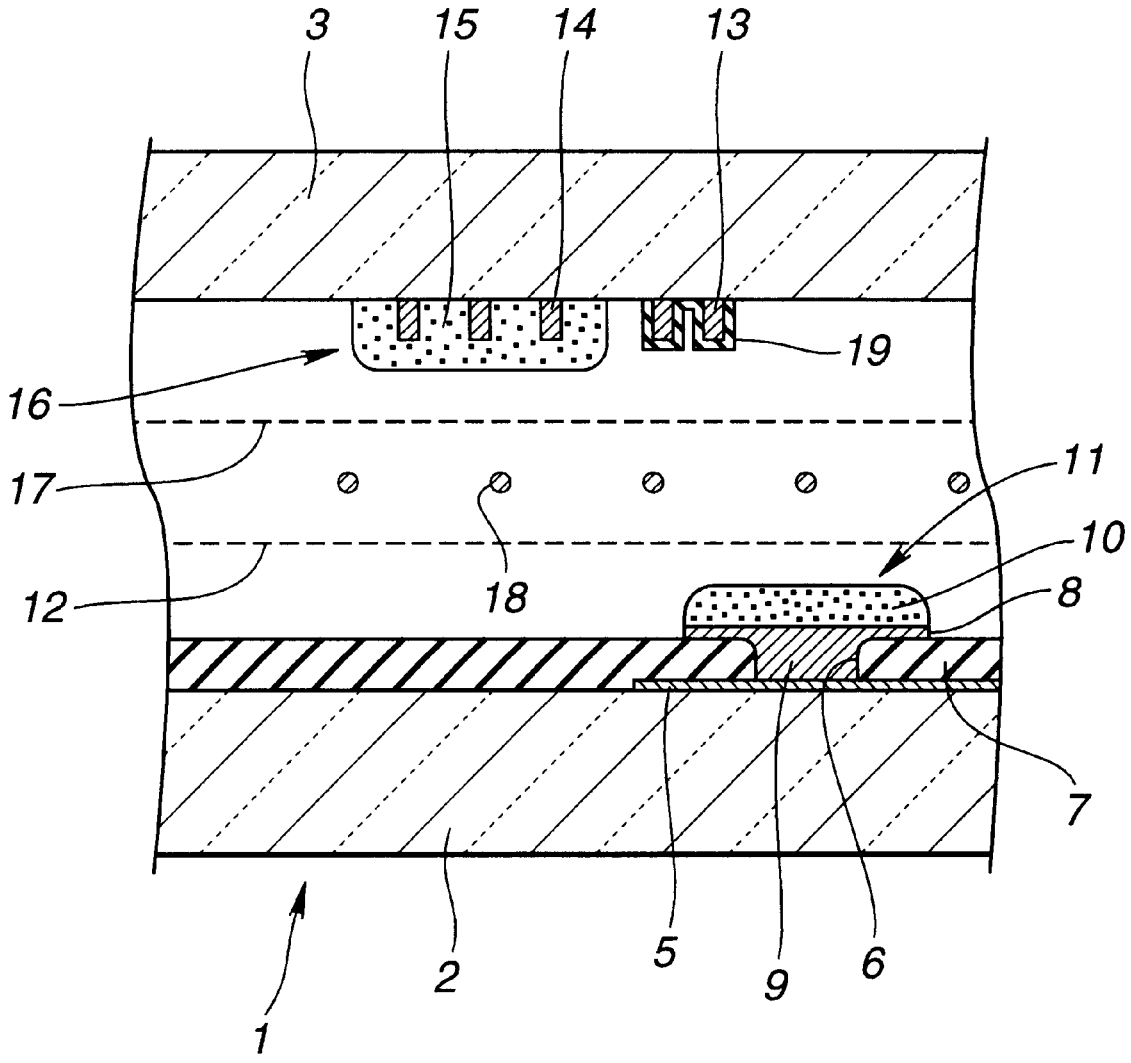
FIG. 1 is a partially enlarged side sectional view showing an embodiment of a double-faced fluorescent display tube according to the present invention.

As shown in FIG. 1, the double-faced fluorescent display tube of this embodiment has a box-like envelope 1 formed of an insulating plate material such as glass. The envelope 1 is assembled from a back substrate 2 and a transparent front substrate 3 facing each other with a predetermined distance therebetween and a frame-like side plate attached fixedly to an outer periphery of the substrates 2 and 3. The envelope 1 is kept vacuum in the interior thereof.

As shown in FIG. 1, a wiring pattern 5 composed of an Al thin film is formed on an inner surface of the back substrate 2. A black color insulating layer 7 having a through-hole 6 is formed on the wiring pattern 5. An anode 8 is formed on the through-hole 6 of the insulating layer 7. The anode 8 is connected to the wiring pattern 5 through a conductive material 9 which the through-hole 6 is filled with. A phosphor layer 10 is formed on the anode 8, thereby constituting a back-side luminescent display portion 11. A mesh grid 12 is placed as a back-side control electrode over the back-side luminescent display portion 11 at a predetermined distance away therefrom.

As shown in FIG. 1, wiring patterns 13 composed of the Al thin film are formed on the inner surface of the front substrate 3 with a predetermined distance therebetween. A part of the wiring pattern 13 is connected to transparent anodes 14. The anode 14 is constituted in such a manner that a light is emitted from a gap between stripe-like patterns composed of the Al thin film, for example. A phosphor layer 15 is formed on the anodes 14, thereby constituting a front-side luminescent display portion 16. A mesh grid 17 is placed as a front-side control electrode under the front-side luminescent display portion 16 at a predetermined distance away therefrom. In the envelope 1, filamentary cathodes 18 are stretchedly disposed between the mesh grids 12 and 17.

The wiring pattern 13, which is formed on the front substrate 3 except the portion having the luminescent display portion 16, is covered with a transparent insulating film 19. A paste material, which is obtained by mixing organic $SiO_2$ and solvent (e.g., butyl carbinol and acetate, etc.), is used as the insulating film 19 so that a patterning can be facilitated. The wiring pattern 13 is covered with the insulating film 19 of $(SiO_2)_n$ through a sol-gel process in which the paste material is formed on the wiring pattern 13 by screen printing (hereinafter referred to as printing) and then sintered.

Although the insulating film 19 can be evaporated on the wiring pattern, it is inefficient and also costly to evaporate the insulating films 19 one by one in a vacuum system. In this embodiment, the insulating film ($SiO_2$ film) 19 is therefore formed by printing. If a film thickness of the obtained insulating film 19 is too thin, the insulating film 19 is difficult to cover the wiring pattern 13. If the film thickness is too thick, a film quality is deteriorated, thus yielding poor adhesiveness to the front substrate 3. Consequently, the insulating film 19 is formed so as to have a thickness of about 0.1 to 0.5 $\mu$m. Although this thickness is greater than the thickness of the film formed by evaporation, it has less light absorption and has no adverse effect on the display.

Figure 2:
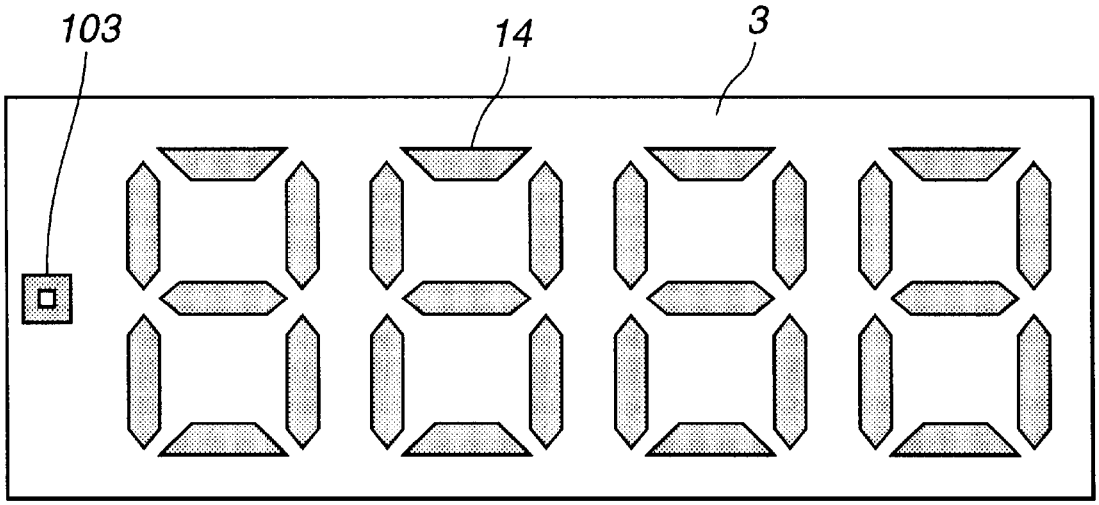
FIG. 2 is a schematic plan view of the double-faced fluorescent display tube according to another embodiment of the present invention.

FIG. 2 is a schematic plan view of the double-faced fluorescent display tube according to another embodiment of the present invention. In FIG. 2, there are omitted the wiring pattern and external terminal and shown the anodes 14 for displaying a four-digit number, each comprising seven segments, mounted on the inner surface of the front substrate 3 and a first register mark 103.

Figure 3:
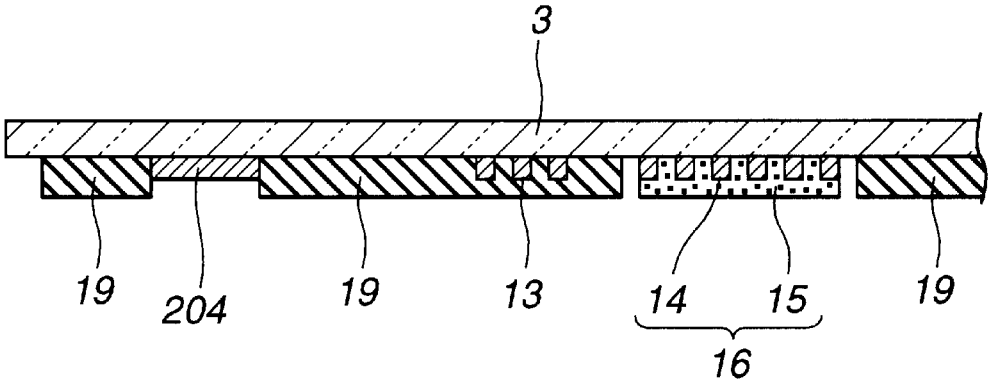
FIG. 3 is an elevational view partly in section of the double-faced fluorescent display tube according to the embodiment of the present invention.

FIG. 3 is an elevational view partly in section of the double-faced on fluorescent display tube shown in FIG. 2. In FIG. 3, the transparent anodes 14, each comprising seven segments; the wiring patterns 13; an internal terminal 204 connected to the external terminal (not shown); the phosphor layer 15; and the transparent insulating film 19 formed of $SiO_2$ are formed on the inner surface of the front substrate 3. The anodes 14 and the phosphor layer 15 constitute the luminescent display portion 16. The insulating film 19 is deposited over the front substrate 3 except the internal terminal 204 and the luminescent display portion 16. When a self-supporting grid is used, the insulating film 19 is deposited on the front substrate 3 except the internal terminal (not shown) which the grid is deposited on, as well as the terminal 204 and the portion 16. Since the wiring patterns 13 are thus covered with the insulating film 19, it is possible to prevent a short-circuit between the wiring patterns 13 due to a getter film or the like.

Figure 4:
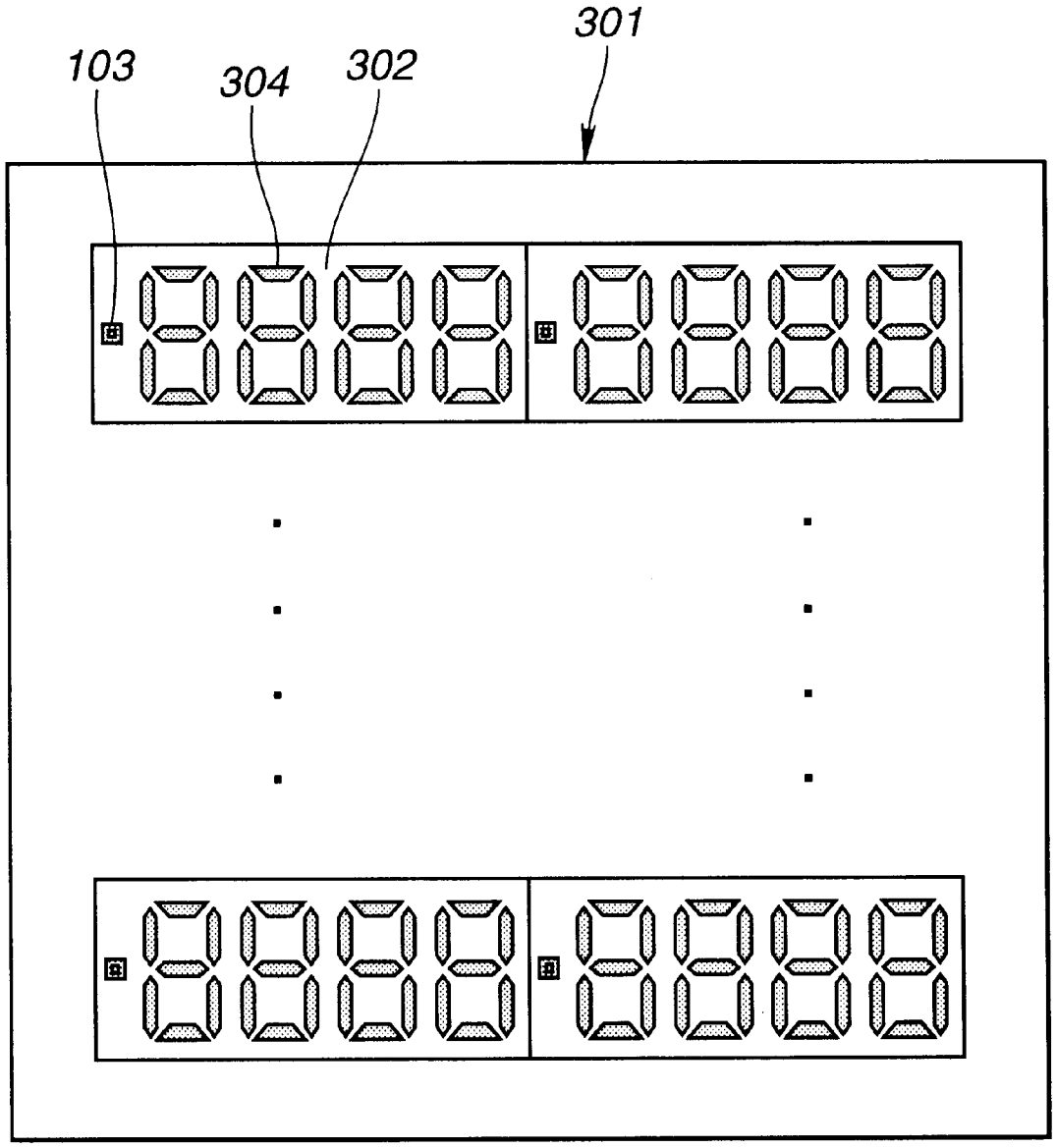
FIG. 4 is a schematic plan view of a mask for use in the embodiment of the present invention.

FIG. 4 shows a mask 301 which is used as a first patterning member for forming the anodes 14 or the like on the front substrate 3. In FIG. 4, conductive patterns 302 for a plurality of fluorescent display tubes are formed on the mask 301. A pattern 304 for the anode 14 and the first register mark 103 are provided as the conductive pattern 302 for each fluorescent display tube. Although not shown in FIG. 4, the wiring pattern and the pattern for the internal terminal are also formed on the mask 301.

Figure 6A:
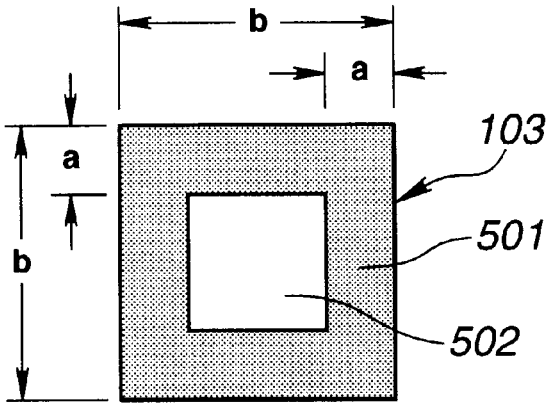
FIG. 6 is an enlarged plan view of a register mark for use in the embodiment of the present invention.

FIG. 6(A) is an enlarged view showing the shape of the register mark 103. In FIG. 6(A), the register mark 103 is rectangular. The register mark 103 has a square blank 502 which is formed in the center of a square conductor-deposition portion 501 whose one side is b. The conductor-deposition portion 501 is a portion on which the conductive material is to be deposited corresponding to the portion 501. The blank 502 is a portion on which the conductive material is not to be deposited. Each side of the conductor-deposition portion 501 has a width a. The width a represents a tolerance within which a problem, e.g., the anode 14 and the internal terminal covered with the insulating film 19, the exposed wiring pattern, etc., is not caused even if the insulating film 19 is misaligned.

The anode 14, the register mark 103, the wiring pattern 13 and the internal terminal 204 are deposited on the front substrate 3 by the Al thin film through photolithography by the use of the mask 301.

Figure 5:
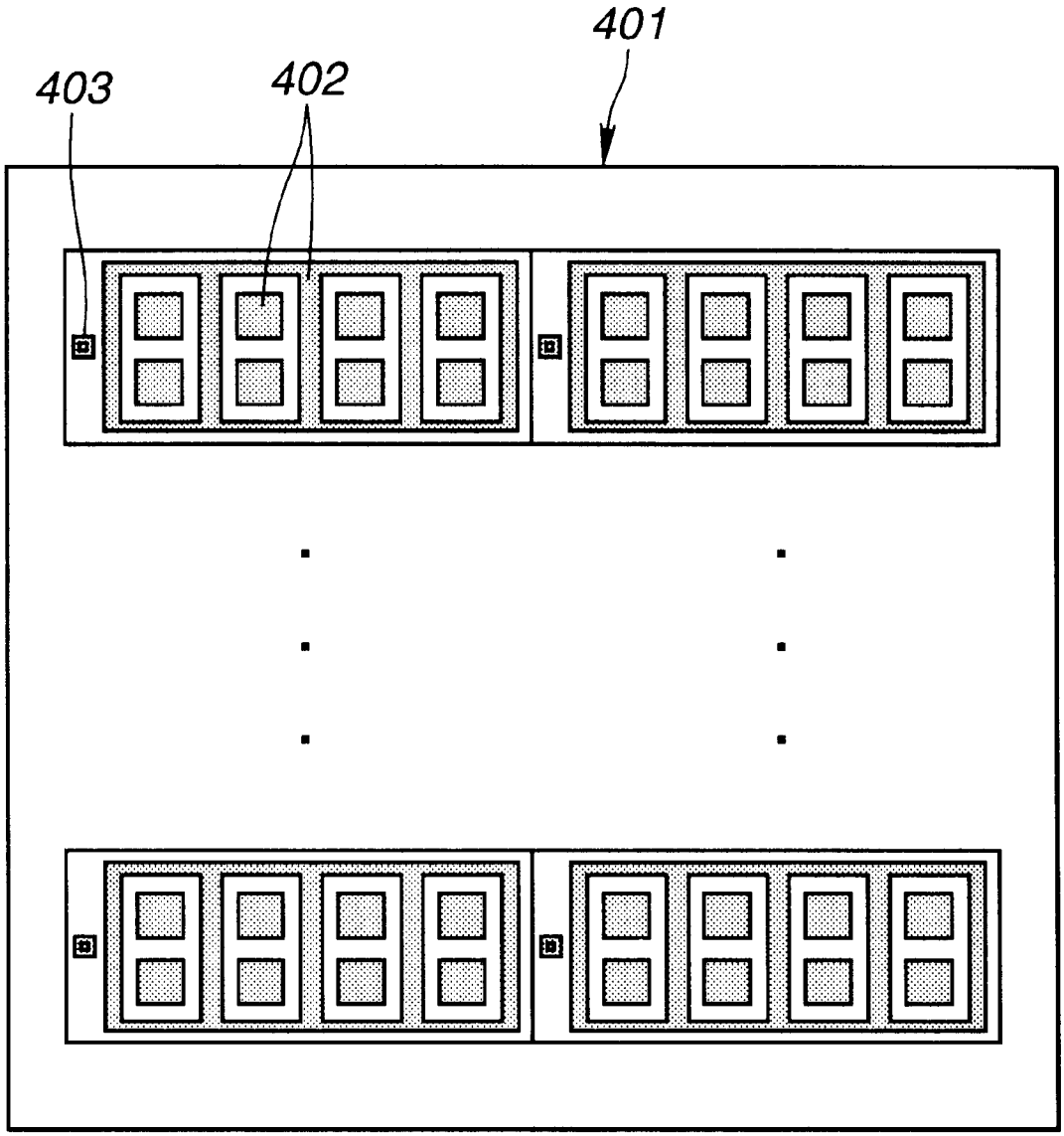
FIG. 5 is a schematic plan view of a screen for use in the embodiment of the present invention.

On the other hand, FIG. 5 shows a screen 401 which is used as a second patterning member for forming the insulating film 19 on the front substrate 3. In FIG. 5, insulating layer patterns 402 for a plurality of fluorescent display tubes are formed on the screen 401. The insulating layer pattern 402 for each fluorescent display tube is formed so that it can be printed on the front substrate except the anode 14 and the internal terminal 204. A second register mark 403 is also provided.

Figure 6B:
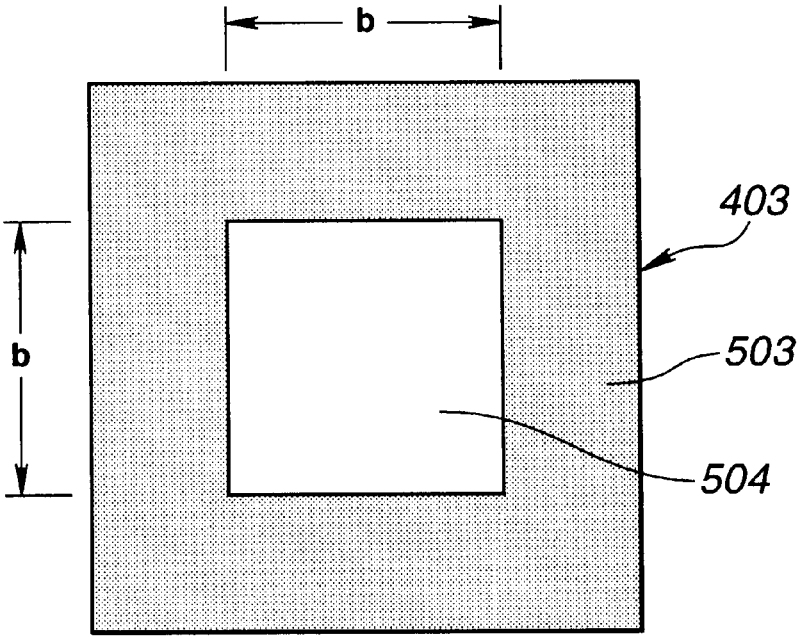

FIG. 6(B) is an enlarged view showing the shape of the register mark 403. In FIG. 6(B), the register mark 403 is rectangular. The register mark 403 has a square blank 504 which is surrounded by an insulator-deposition portion 503 and whose one side is the same as an outer dimension b of the register mark 103. The insulator-deposition portion 503 is a portion on which an insulating material is to be deposited corresponding to the portion 503. The blank 504 is a portion on which the insulating material is not to be deposited.

When the insulating film 19 is formed on the front substrate 3 by the use of the screen 401, the register mark 403 of the screen 401 is positioned by matching it to the register mark 103 formed on the front substrate 3. The insulating film 19 is overlap-printed by screen printing so that it is deposited on the front substrate 3.

FIG. 7 is a partially front view for illustrating a method of aligning the screen in the overlap-printing by the use of the screen.

In FIG. 7, the mask is first used so as to deposit the register mark 103, as well as the anodes or the like, on the inner surface of the front substrate 3. Then, the register mark of the screen is matched to the register mark 103, whereby a register mark 601, as well as the insulating film, is deposited on the front substrate 3.

Figure 7A:
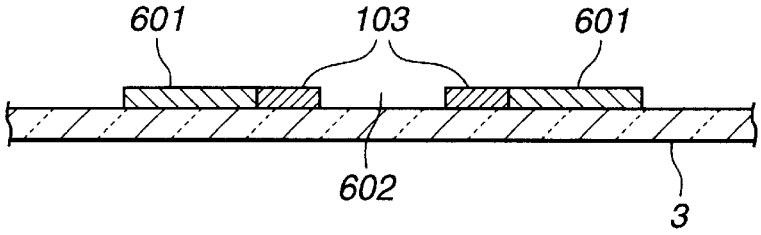
FIG. 7 is an illustration of an alignment in the embodiment of the present invention.

FIG. 7(A) exemplifies the printing which is performed when the screen 401 is in perfect alignment. The register mark 103 formed on the inner surface of the front substrate 3 correspondingly to the register mark 403 perfectly matches the blank of the register mark 601 printed correspondingly to the register mark. In this condition, the insulating film perfectly matches the conductive pattern such as the anode and the wiring pattern. The double-faced fluorescent display tube is therefore manufactured in which the short-circuit is prevented from occurring between the wiring patterns.

Figure 7B:
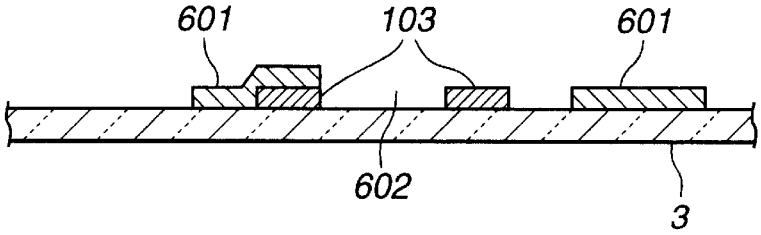
Figure 7C:
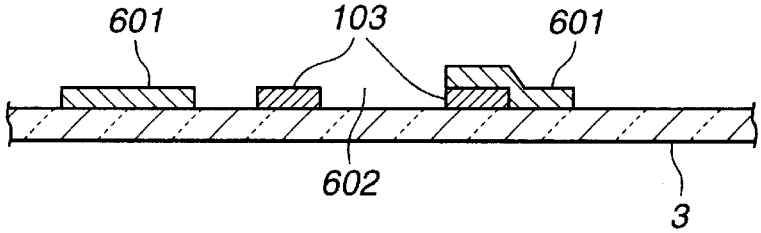

FIGS. 7(B) and 7(C) exemplify the register mark 601 which is formed when the screen 401 is misaligned within the above-described tolerance. FIG. 7(B) exemplifies the register mark 601 which is formed when the screen 401 is misaligned rightward. FIG. 7(C) exemplifies the register mark 601 which is formed when the screen 401 is misaligned leftward.

In both of FIGS. 7(B) and 7(C), the register mark 601 does not reach the inside of a blank 602 of the register mark 103. In this condition, although the conductive pattern such as the anode 14 and the wiring pattern 13 and the insulating film 19 are slightly misaligned, they are formed within the above-mentioned tolerance for misalignment. The double-faced fluorescent display tube is therefore manufactured in which the short-circuit is prevented from occurring between the wiring patterns 13.

Figure 7D:
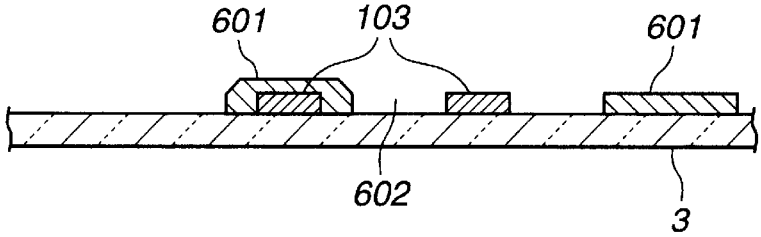
Figure 7E:
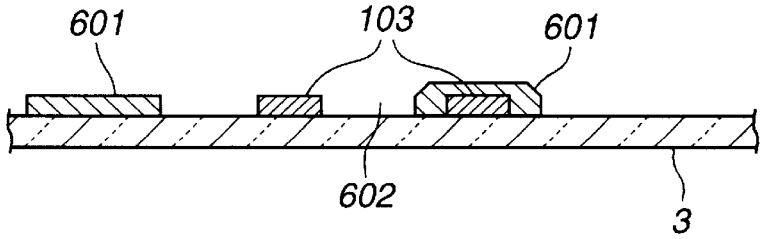

FIGS. 7(D) and 7(E) exemplify the register mark 601 which is deposited when the screen 401 is misaligned beyond the above-described tolerance. FIG. 7(D) exemplifies the register mark 601 which is deposited when the screen 401 is misaligned rightward. FIG. 7(E) exemplifies the register mark 601 which is deposited when the screen 401 is misaligned leftward.

In both of FIGS. 7(D) and 7(E), the register mark 601 is deposited while it reaches the inside of the blank 602 of the register mark 103. In this condition, the conductive pattern such as the anode 14 and the wiring pattern 13 and the insulating film 19 are misaligned relatively beyond the tolerance. This causes troubles. That is, the short-circuit is caused due to the exposed wiring pattern 13, or the light is improperly emitted from the luminescent display portion 16 due to the anode 14 covered with the insulating film 19.

Accordingly, the insulating film 19 is deposited by visually aligning the screen 401 so that it may be formed within the tolerance of FIGS. 7(A)–7(C). Thereby, it is possible to manufacture the double-faced fluorescent display tube in which the short-circuit is prevented from occurring between the wiring patterns 13.

Next, the description will be provided for the step of forming the display portion on the side of the front substrate 3 shown in FIG. 3 in the method of manufacturing the double-faced fluorescent display tube.

On the inner surface of the transparent glass front substrate 3, the wiring pattern 13, the internal terminal 204 connected to the wiring pattern 13, the stripe-like or mesh-like and thus transparent anode 14 connected to the wiring pattern 13 and the register mark 103 are formed of the Al thin film through photolithography by the use of the mask 301.

Then, the phosphor layer 15 is deposited on the anode 14 by screen printing or electrodeposition. This layer is sintered and fixed, thereby forming the luminescent display portion 16.

Subsequently, the register mark 403 of the screen 401 is visually matched to the register mark 103 within the tolerance for misalignment, whereby it is positioned. The paste material containing $SiO_2$ is formed by screen printing and then sintered and fixed. The portion except the luminescent display portion 16 and the internal terminal 204 is thus covered with the insulating film 19, thereby forming openings corresponding to the luminescent display portion 16 and the internal terminal 204.

The control electrode 17 is then bonded, by conductive adhesive, to an internal electrode (not shown) for the control electrode formed on the inner surface of the front substrate 3 so that it is positioned opposite to the luminescent display portion 16 and at a predetermined distance away therefrom. Thereby, the luminescent display portion on the side of the front substrate 3 is finished.

Thereafter, the front substrate 3, the back substrate 2 on which the luminescent display portion is formed, the cathode 18, the external terminal and the side plate are assembled. The assembly is evacuated/sealed and then gettered, whereby the double-faced fluorescent display tube is finished.

In the double-faced fluorescent display tube according to this embodiment, the exposed portion of the wiring pattern 13 on the side of the front substrate 3 is covered with the transparent insulating film 19, or particularly the $SiO_2$ film. It is thus possible to reduce insulation failure caused due to conductive contaminants or the like produced in the manufacturing step which has been heretofore regarded as the problem.

Furthermore, the effect will be described. The prior-art constitution shown in FIG. 9 having the exposed wiring pattern has a rate of insulation failure of 0.61%. On the other hand, the constitution of this embodiment, in which the exposed portion of the wiring pattern 13 is covered with the insulating film 19, has a rate of insulation failure of 0%.

The effect will be described from the viewpoint of properties of the double-faced fluorescent display tube. As shown in Table 1, an anode current and a luminous efficiency are assumed as 100% when the $SiO_2$ film is not formed on the exposed portion of the wiring pattern. The constitution of this embodiment, in which the exposed portion of the wiring pattern is covered with the $SiO_2$ film (insulating film), can prevent electrons emitted from the cathode from colliding with the wiring pattern. Consequently, an ineffective current of the anode is reduced to about 50%. Also, the luminous efficiency of the phosphor is improved.

TABLE 1

| | Anode current | Luminous efficiency |
|---|---|---|
| No $SiO_2$ film | 100% | 100% |
| $SiO_2$ film | 54% | 174% |

Figure 8:
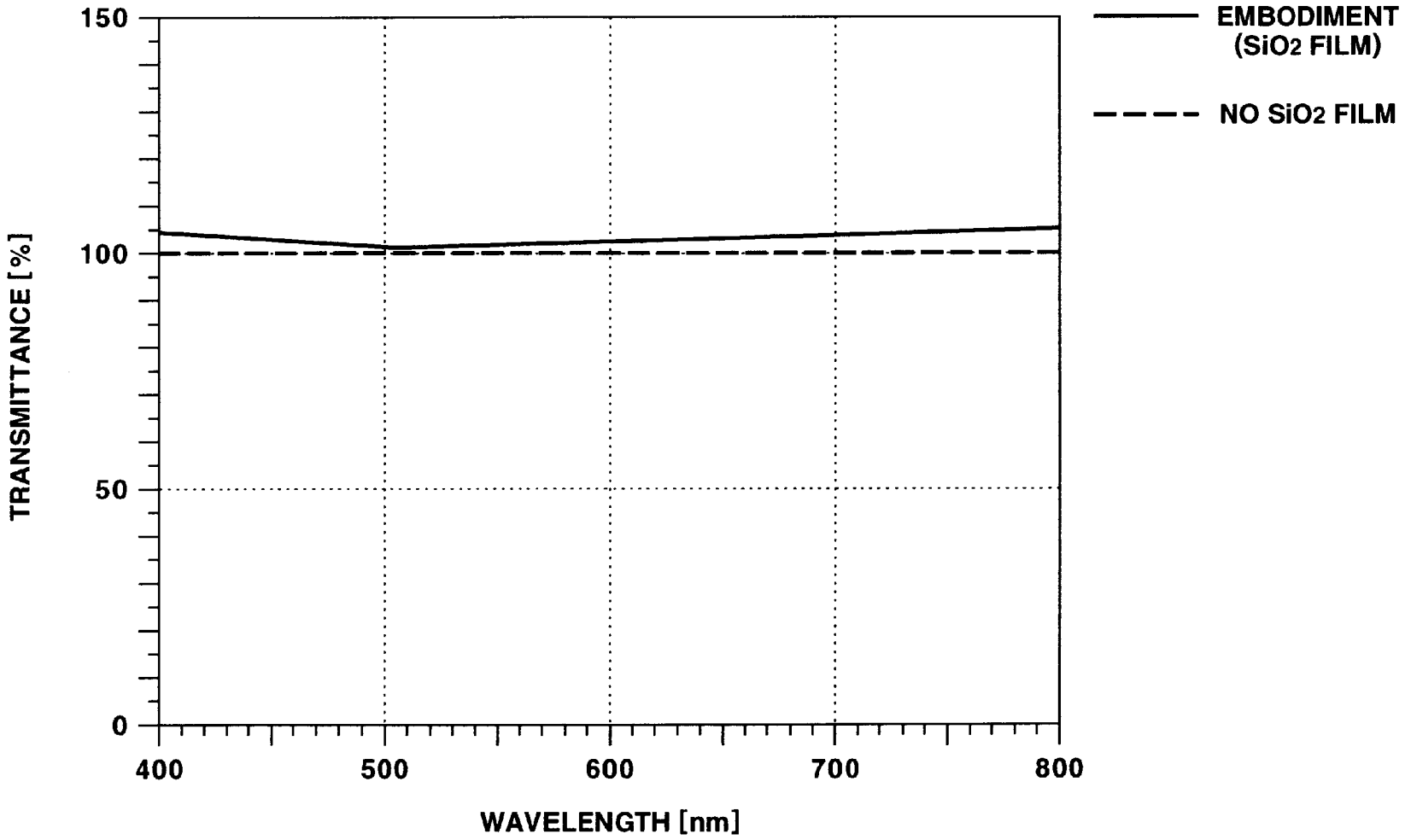
FIG. 8 is a graph showing a comparison of transmittance between two substrates: one substrate belonging to the double-faced fluorescent display tube according to the present invention having a wiring pattern covered with an insulating film, and the other substrate belonging to the prior art having the wiring pattern that is not covered with the insulating film.

As shown in FIG. 8, transmittance is increased by a few percents, even compared to transparent glass having the wiring pattern that is not covered with the insulating film ($SiO_2$ film).

In the above-mentioned embodiments, the fluorescent display tube has been described in which the luminescent display portions are formed on both the facing substrates (back and front substrates 2 and 3). However, the above constitution can be also applied to a general vacuum fluorescent display tube (VFD) and other display devices.

As can be clearly seen from the above description, according to the present invention, the exposed portion of the wiring pattern on the side of the front substrate is covered with the transparent insulating film. Thus, it is possible to reduce the insulation failure caused due to the conductive contaminants or the like produced in the manufacturing step which has been heretofore regarded as the problem. Moreover, it is possible to prevent the electrons emitted from the cathode from colliding with the wiring pattern. As a result, the ineffective current of the anode can be reduced, and the luminous efficiency of the phosphor can be also improved.

Moreover, the method of manufacturing the double-faced fluorescent display tube according to this embodiment, the tube comprising the envelope 1 formed of the facing front and back substrates 3 and 2 and the side plate, the envelope 1 including: the inner surface of the front substrate 3 having a plurality of luminescent display portions 16 composed of the phosphor layer 15 and the anodes 14 which the phosphor layer 15 is deposited on, the wiring pattern 13 which a plurality of anodes 14 are connected to, and the internal terminal 204 connected to the wiring pattern 13; the cathodes 18 for emitting the electrons; and the control electrode 17 arranged between the luminescent display portions 16 and the cathodes 18, the method comprises the steps of: forming the anodes 14, the wiring pattern 13, the internal terminal 204 and the first register marks 103 of the conductive material on the front substrate 3 by using the mask 301 having a plurality of first register marks 103 whose shape represents the misalignment tolerance which is the level that is allowed even when the screen 401 is misaligned; and printing the insulating film 19 on the front substrate 3 with the transparent insulating material by using the screen 401 having a plurality of second register marks 403 corresponding to the insulating layer pattern 402 and the first register marks 103, while the second register marks 403 are matched to the first register marks 103 within the misalignment tolerance. Thus, the wiring pattern 13 can be properly covered with the insulating film 19. It is therefore possible to manufacture the double-faced fluorescent display tube in which the short-circuit can be prevented from occurring between the wiring patterns 13. Moreover, it is possible to form the opening of the insulating film 19 with high precision and thus to reduce the problem such as display failure of the luminescent display portion 16.

The first register mark 103 is formed of a rectangular mark whose width is equal to the misalignment tolerance, whereby it is possible to prevent the misalignment in two directions perpendicular to each other.

Moreover, the second register mark 403 is formed of the mark having the blank whose dimension is identical with the outer dimension of the first register mark 103, thereby facilitating the alignment.

Furthermore, the insulating layer pattern 402 formed on the second patterning member is constituted so that the insulating film 19 can be formed over the front substrate 3 except the luminescent display portion 16 and the internal terminal 204, thereby further ensuring that the short-circuit can be prevented from occurring between the wiring patterns 13.

It is not always necessary to form the register marks 103 and 403 for each fluorescent display tube as shown in FIGS. 4 and 5. A plurality of register marks may be formed at any positions corresponding to the mask 301 and the screen 401.

What is claimed is:

1. A double-faced fluorescent display tube comprising:

an envelope formed of two substrates facing each other whose outer periphery is sealed, in which the respective inner surfaces of said substrates have a luminescent display portion and a wiring pattern connected to said luminescent display portion, wherein an exposed portion of said wiring pattern is covered with a transparent insulating film.

2. A double-faced fluorescent display tube comprising:

an envelope formed of back and front substrates facing each other and a frame-like side plate sealed between said back and front substrates, in which an inner surface of said back substrate has a wiring pattern, a black color insulating layer which said wiring pattern is covered with, an anode disposed on said insulating layer and connected to said wiring pattern through a through-hole, a phosphor layer disposed on said anode, and a control electrode disposed at a predetermined distance away from said phosphor layer, an inner surface of said front substrate has a wiring pattern, transparent anodes connected to said wiring pattern, a phosphor layer disposed on said anodes, and a control electrode disposed at a predetermined distance away from said phosphor layer, and cathodes are stretchedly disposed between said control electrodes, wherein an exposed portion of said wiring pattern on said front substrate is covered with a transparent insulating film.

3. A double-faced fluorescent display tube as defined in claim 2, wherein the whole surface of said front substrate is covered with a transparent insulating film, except said luminescent display portion and an internal terminal.

4. A double-faced fluorescent display tube as defined in claim 1, 2 or 3, wherein said insulating film comprises $SiO_2$ thin film.

* * * * *